United States Patent [19]

Platell

[11] Patent Number: 4,735,257

[45] Date of Patent: Apr. 5, 1988

[54] ARRANGEMENT IN INTERNAL PANELS FOR ELIMINATING COLD RADIATING SURFACES ON WALLS, CEILINGS AND FLOORS

[75] Inventor: Ove B. Platell, Sigtuna, Sweden

[73] Assignee: Future Energy AB, Stockholm, Sweden

[21] Appl. No.: 6,749

[22] Filed: Jan. 27, 1987

Related U.S. Application Data

[63] Continuation-in-part of Ser. No. 783,002, Oct. 2, 1985, abandoned, which is a continuation-in-part of Ser. No. 545,397, Oct. 11, 1983, abandoned.

[30] Foreign Application Priority Data

Mar. 8, 1982 [SE] Sweden ..... 8201435-8

[51] Int. Cl.[4] ..... B60H 1/00; B61D 27/00; F24H 3/08; E06B 7/12

[52] U.S. Cl. ..... 165/39; 165/40; 165/56; 237/69; 52/171

[58] Field of Search ..... 165/32, 25, 39, 40, 165/53, 56, 48; 52/171; 237/69; 98/31

[56] References Cited

U.S. PATENT DOCUMENTS

| | | | |
|---|---|---|---|
| 1,768,941 | 7/1930 | Sweatt | 165/32 |
| 2,038,578 | 4/1936 | Lamb | 165/40 |
| 2,176,586 | 10/1939 | Goerg | 165/56 |
| 2,205,001 | 6/1940 | Timmis et al. | 165/56 |
| 2,442,201 | 5/1948 | Elberty, Jr. | 165/56 |
| 3,204,379 | 9/1965 | Osborn | 98/31 |
| 3,590,913 | 7/1971 | Tschudin | 165/48 |
| 3,981,445 | 9/1976 | Custer | 165/56 |
| 4,090,663 | 5/1978 | Bonne et al. | 165/40 |
| 4,114,682 | 9/1978 | Knud | 165/39 |
| 4,189,093 | 2/1980 | Schnaibel et al. | 165/40 |

*Primary Examiner*—Albert W. Davis, Jr.
*Assistant Examiner*—John K. Ford
*Attorney, Agent, or Firm*—Kinzer, Plyer, Dorn, McEachran & Jambor

[57] ABSTRACT

The invention relates to an arrangement in an interior panel (2) or the like having a rearwardly located space through which air which has been heated is arranged to flow, to eliminate the radiation of cold from a wall, a floor or the like. In accordance with the invention, the space is confined and divided into at least two thin air cavities (4,5), by means of an intermediate plate (3) which extends parallel to the interior panel (2) and which comprises a material having good heat-insulating properties. The heated air is arranged to be circulated in the air cavities, around the intermediate plate. A heater is provided for heating the air passing to the air cavity (4) adjoining the interior panel, to a temperature of at most some few degrees above the room temperature. A fan (10) is controlled by an air flow control regulator (10') which is actuated by a thermostat (14) which compares the temperature of the air as it moves out of the inner space (4) with the intended room temperature.

2 Claims, 1 Drawing Sheet

Fig. 1.
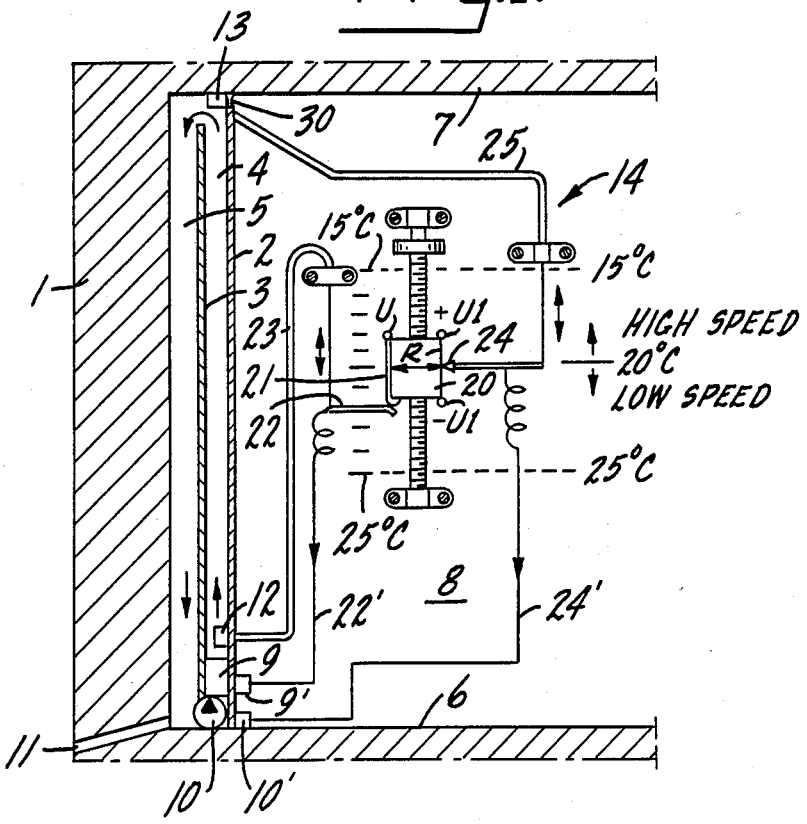
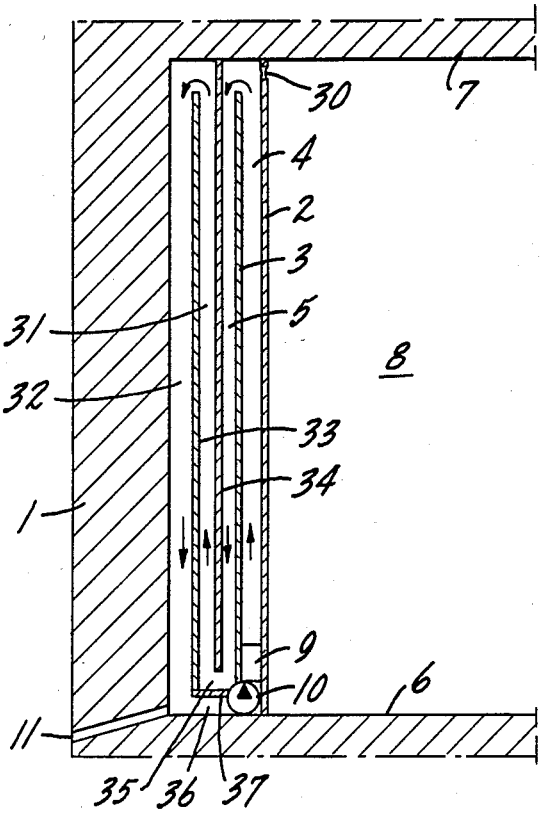
Fig. 2.

ARRANGEMENT IN INTERNAL PANELS FOR ELIMINATING COLD RADIATING SURFACES ON WALLS, CEILINGS AND FLOORS

This is a continuation-in-part of my co-pending application Ser. No. 06/783,002, filed Oct. 2, 1985, now abandoned, which was a continuation-in-part of application Ser. No. 06/545,397, filed Oct. 11, 1983, now abandoned.

SUMMARY OF THE INVENTION

The present invention relates to an arrangement in internal panels or the like having rearwardly thereof a space through which warmed air is arranged to flow, thereby to eliminate the radiation of cold from a room surface, such as the surface of a wall, floor and/or ceiling.

The comfort criterion of a heated room is the socalled directive operative temperature. The value of this temperature is determined by the radiation climate and the air temperature at selected points in the room. The radiation climate is affected negatively by room surfaces which are cold due to transmission losses, i.e., which radiate cold into the room. An improvement can be achieved, by flushing the space behind the panel with air which has been heated, suitably supply air or exhaust air. Because of the heat lost to the external surroundings, it is necessary for the air to flow at a high rate, so as to prevent the temperature of the air stream, and therewith also the temperature of the internal panel, from falling beneath room temperature on the outlet side. The heat losses and difficulties in achieving requisite flow rates in a confined space have meant that solutions of this kind are not totally realistic.

It is, however, highly desirable to find a solution to the problem of bringing the internal panel to a sufficiently high surface temperature, uniformly over the whole of said surface, since tests have shown that the room temperature can be lowered one or two degrees while maintaining a comfortable room-climate, if cold-radiation from walls, floors and ceilings can be totally eliminated, by bringing these surfaces to a temperature which is substantially equal to the temperature of the room, or slightly higher. In this latter case, the surface which was previously a cold-radiating surface is now a heat-emitting surface. This enables the number of other heat-emitters in the room to be reduced, or renders the need for such further heat-emitters unnecessary.

A solution to the aforesaid problem is afforded by the invention, by providing an arrangement of the kind described in the introduction with the characterizing features set forth in the following claims. The temperature curve followed by the air circulating around the intermediate plate, the surface temperature of the interior panel, and the total transmission loss are determined by a number of parameters. Among these are included the original K-value of the wall, the internal radiation characteristics of the double cavity, the resistance to thermal transmission, air replacement, and the inlet temperature of the air. By passing the air (either in total or in part) through the air gap which lies closest to the innermost cavity, subsequent to said air having passed the innermost air gap, the intermediate plate is held at a higher temperature than in the case when the air is passed solely through the innermost gap (in the case of a single cavity). This means that when the air passes through the innermost cavity, it is not cooled as greatly as when passed through a single cavity. This enables the air-flow to be lowered, or the inlet temperature to be lowered, while still maintaining the panel at the same temperature level as in the single cavity case.

BRIEF DESCRIPTION OF THE DRAWINGS

The invention will now be described in more detail with reference to two different embodiments of arrangements according to the invention illustrated schematically in the accompanying drawing, in which FIG. 1 is a cross-sectional view of a wall provided with a double cavity in accordance with the invention, and FIG. 2 is a cross-sectional view of a wall having two double cavities connected in series, in accordance with another embodiment of the invention.

DETAILED DESCRIPTION OF THE INVENTION

FIG. 1 illustrates an outer wall 1 constructed in a conventional manner. Extending parallel with the inside of the wall, at a distance of, for example, 5 cm therefrom, is an interior panel 2. The space defined in this manner is divided by means of an intermediate plate 3 of suitable high-insulating material extending parallel with the interior panel 2, into an inner air cavity 4 and an outer air cavity 5. The interior panel 2 extends between a floor 6 and a ceiling 7 in a room 8, while the intermediate plate 3, on the other hand, is arranged to leave a free opening at the top and bottom of said plate. Arranged in the lower part of the cavity 4 is an elongated heating means 9, the effect of which is such that the air in the double cavity 4, 5 strives to flow in the circulation direction shown by the arrows, as a result of the cooling effect of the outer wall 1 on the air in the cavity 5, and as a result of heating the air flowing into the cavity 4 by the heating means 9. A heat control means 9' controls the heating means 9 in response to the temperature difference as sensed by a temperature sensing device 12 and an intended room temperature set by a thermostat 14, the temperature sensing device 12 being located immediately above the heating means 9. For the purpose of controlling the air flow in the flow circuit, a positive air displacement means 10 is arranged beneath the heating means 9. The means 10 includes all kinds of speed controlled fans and so-called air flow controlled air movers. Such air movers include air ejectors. A flow control means 10' is provided for regulating the air flow induced by the positive air displacement means 10 in response to the temperature difference sensed by a temperature sensing device 13 located at the outlet of cavity 4 and the intended room temperature set by thermostat 14.

In addition, a narrow passage 11 is arranged to connect the double cavity 4, 5 with the outside of the wall 1, so that the same dew-point prevails as that outside, thereby to prevent condensation in the double cavity 4, 5.

There are many different thermostats applicable for controlling the temperature. There are mainly two types of thermostats: (a) on/off output and (b) variable output. In this case, the heat control means 9' is connected to an on/off power source, i.e., to power U when the temperature sensing device 12 calls for heat and is disconnected when the intended temperature is sensed by the sensing device 12, which in this case is equal to the intended room temperature plus 2° C. The on/off output varies between a constant voltage and zero.

The flow control means 10' is operated by a variable output source such that the speed of a fan 10, which is of the variable speed type, is increased as the temperature sensed by device 13 falls below the intended temperature and is decreased to a low speed value as the temperature sensed by device 13 rises to the intended temperature.

The thermostat 14 comprises a vertically movable part 20 for setting the intended room temperature between 15° C. and 25° C. indicated on a fixed graduate scale. The movable part 20 is provided with a contact 21 connected to a voltage source U and a linear resistance R having an upper end connected to a voltage source +U1 and a lower end connected to a voltage source −U1.

The contact 21 is adapted to cooperate with a movable contact 22 supported by a mechanical connection 23 operated by the temperature sensing device 12 such that the contact 22 indicates on the scale the temperature value sensed by device 12. Contact 22 is connected to means 9' by an electrical line 22'.

The resistance R is adapted to cooperate with a movable contact 24 supported by a mechanical connection 25 operated by the temperature sensing device 13 such that the contact 24 indicates on the scale the temperature value sensed by device 13. Contact 24 is connected to means 10' by an electrical line 24'.

FIG. 1 shows the movable part 20 set to 20° C., the movable contact is positioned at 22° C. where is touches contact 21, and contact 24 is positioned at a point between +U1 and −U1 voltage source where the voltage is zero indicating that the temperature sensed by device 13 is equal to the intended room temperature, i.e., the speed of the fan 10 is correct.

If the temperature sensed by device 12 is increased, contact 22 is moved downwards and is disconnected from contact 21 and the heating means 9 is disconnected. Now sensing device 12 calls for heat and the contact 22 starts moving upwards until it touches contact 21 and the heating means 9 is connected again, and the on/off-operation is continued.

If the temperature sensed by device 13 is increased, contact 24 is moved downwards a small distance causing a negative voltage to appear on line 24' in turn causing the control means 10' to reduce the speed of the fan 10 such that the temperature sensed by device 13 is decreased and the contact 24 is moved back to the zero position corresponding to a temperature sensed by device 13 which is equal to the intended room temperature, and vice versa if the temperature sensed by device 13 is initially decreased.

The heating means 9 is preferable of the counterflow type, and is connected to a hot water line and a return line (not shown), whereby a substantially constant temperature can be maintained along the whole length of the heating means 9, along the lower part of the cavity 4.

Heating of the air is so adapted that when the air enters the cavity 4, it has a temperature which is only a few degrees higher than the intended room temperature.

The air flow is set by means of the positive air displacement means 10, so that in the transition region from the upper part of the cavity 4 to the cavity 5, the air temperature is substantially equal to the intended room temperature, which can also mean a temperature which is about 0.5°–1.0° C. lower than said temperature.

The temperature of the interior-panel surface is then practically constant over the whole of said surface, and, for example, equal to the intended room temperature.

With an outside temperature of, for example, −20° C., cooling of the air in the cavity 5 may be so great that the temperature of the air entering the heating means 9 reaches to only about 11° C. With an effective counterflow heat-exchanger in the heating means 9, the temperature of the water supplied need only be about 25° C., and the temperature of the return water about 13° C. With a temperature difference between the incoming and outgoing circulation water of about 12° C., the water flow may be equally as large as that employed in current practice in existing buildings. This means that when additionally insulating existing buildings, the radiator serving pipelines present therein can be used for connecting the heating means 9. A still greater advantage afforded by the arrangement according to the invention is that a heating system with a water temperature of 25°/13° C. can be supplied with low-grade energy, particularly solar energy with low-temperature solar collectors of the simplest construction having a high degree of efficiency at these low temperatures.

FIG. 2 illustrates a variant of the arrangement illustrated in FIG. 1, provided with a further double cavity 21, 22 on both sides of an intermediate plate 23, in a space which is separated from the double cavity 4, 5 by a partition 24. The partition is arranged to leave a free opening at the bottom thereof, to connect the cavities 5, 21 and cavities 4, 22 through connecting passages 25 and 26 respectively, which are divided by a guide plate 27, which connects the lower edges of the intermediate plates 3, 23.

In this embodiment, the temperature in the outermost cavity 22 is even lower than is the case in the embodiment according to FIG. 1, at low surface temperatures, which means that the temperature of the return water will be still lower. Consequently, the outer wall 1 can be designed so as to enable solar energy to be readily taken up by the air flowing in the cavity 22, during the Spring and Autumn periods.

As beforementioned, the arrangement according to the invention can be also applied to floor and ceiling surfaces, which border onto unheated spaces.

Instead of a water-carried heating system, there may be used a hot-air system with central heating and a central fan means.

Furthermore, a minor part of heated air from the innermost cavity 4 may be released into the room 8, through a valve 30, for ventilating the room with warm, fresh air. Cold, fresh air will then flow in through the passage 11.

I claim:

1. A heating arrangement in combination with an outside wall (1) of a room space (8), comprising:

an interior wall panel (2) positioned parallel to and at a distance from the outside wall (1) and enclosing a closed space between the outside wall and the interior wall panel, a partition plate (3) made of a good heat-insulating material positioned in said closed space and dividing the closed space into an inner space (4) between the partition plate (3) and the interior wall panel (2) and an outside space (5) between the partition plate (3) and the outside wall (1), said inner space (4) and outer space (5) communicating through first and second elongated openings at the opposite ends of said partition plate (3), and means (9) at the first of said elongated openings for heating the air in said closed space, characterized by positive air displacement means (10) for circulating the heated air from said first elongated opening through the inner space (4), the second elongated opening, the outer space (5) and back to the first elongated opening, the heating means (9) being arranged to heat the air upon entry into the inner space (4) to a temperature of at most a few degrees above the temperature of the intended room space (8), and the positive air displacement means (10) being controlled to circulate the air in a manner such that subsequent to the passage of the heated air through the inner space (4), the air temperature is substantially equal to the temperature of the intended room space (8), said positive air displacement means (10) being controlled by an air flow control means (10') which is actuated by a thermostat (14) which compares the temperature of the circulated air sensed by a sensing device (13) as it moves out of the inner space (4), with the intended room temperature set on the thermostat (14) sending a resultant signal to the air flow control means (10') based on the temperature difference to regulate the flow of air such that the temperature sensed by the sensing device (13) is substantially equal to the intended room temperature.

2. A heating arrangement according to claim 1 characterized in that the closed space (4, 5) is ventilated to the ambient air by means of one or more narrow pasages (11).

* * * * *